US009091436B2

(12) United States Patent
Homma

(10) Patent No.: US 9,091,436 B2
(45) Date of Patent: Jul. 28, 2015

(54) RICH-LEAN BURNER

(75) Inventor: Tsutomu Homma, Nagoya (JP)

(73) Assignee: Paloma Co., Ltd., Nagoya (JP)

( * ) Notice: Subject to any disclaimer, the term of this patent is extended or adjusted under 35 U.S.C. 154(b) by 632 days.

(21) Appl. No.: 13/363,481

(22) Filed: Feb. 1, 2012

(65) Prior Publication Data

US 2012/0244482 A1 Sep. 27, 2012

(30) Foreign Application Priority Data

Mar. 24, 2011 (JP) ..... 2011-066421

(51) Int. Cl.

| | |
|---|---|
| ***F23Q 9/00*** | (2006.01) |
| ***F23D 14/62*** | (2006.01) |
| ***F23D 14/46*** | (2006.01) |
| ***F23D 14/10*** | (2006.01) |
| ***F23D 14/26*** | (2006.01) |
| ***F23D 14/58*** | (2006.01) |

(52) U.S. Cl.

CPC ..... *F23D 14/46* (2013.01); *F23D 14/105* (2013.01); *F23D 14/26* (2013.01); *F23D 14/586* (2013.01); *F23C 2201/20* (2013.01)

(58) Field of Classification Search

CPC ..... F23D 14/583; F23D 14/586; F23D 14/26
USPC ..... 431/278, 354, 285, 328, 346, 284
See application file for complete search history.

(56) References Cited

U.S. PATENT DOCUMENTS 6,786,717 B2 * 9/2004 Shimazu et al. ..... 431/354

FOREIGN PATENT DOCUMENTS

| | | | |
|---|---|---|---|
| JP | 2001-182910 | A1 | 7/2001 |
| JP | 2006-317070 | A1 | 11/2006 |
| JP | 4072088 | B2 | 4/2008 |
| JP | 2010-261615 | A1 | 11/2010 |

OTHER PUBLICATIONS

Japanese Office Action (Application No. 2011-066421) dated May 1, 2014.

* cited by examiner

*Primary Examiner* — Avinash Savani
*Assistant Examiner* — Vivek Shirsat
(74) *Attorney, Agent, or Firm* — Burr & Brown, PLLC

(57) ABSTRACT

In a rich-lean burner, a gap formed between a lean-flame port and a rich-flame port is in fluid communication with a supply passage through which a lean gas is to be supplied to the lean-flame port. One or more projections are provided on at least one of partition plates disposed between the gap and the lean-flame port and between the gap and the rich-flame port. A recessed portion is formed at a region adjacent to the lean-flame ports at an interface between the distal end of at least one of the projections protruding from one of the partition plates and the other of the partition plates, the distal end of the at least one of the projections being partially not in contact with the other of the partition plates to provide a clearance through which the lean gas is allowed to be supplied to the gap.

3 Claims, 5 Drawing Sheets

RICH-LEAN BURNER

BACKGROUND OF THE INVENTION

This application claims the benefit of Japanese Patent Application Numbers 2011-066421 filed on Mar. 24, 2011, the entirety of which is incorporated by reference.

FIELD OF THE INVENTION

This invention relates to a rich-lean burner (low $NO_x$ burner) for use in a gas combustion apparatus such as a water heater, the rich-lean burner including a lean-flame port from which a lean gas is to be supplied, and a rich-flame port which is disposed adjacent to the lean-flame port and from which a rich gas is to be supplied.

BACKGROUND ART

In a gas combustion apparatus such as a water heater, a rich-lean burner (low $NO_x$ burner) may be used which is configured to form a main flame by burning air-fuel mixture (lean gas) of which the air-fuel ratio is lower than a theoretical air-fuel ratio of the gas at a lean-flame port, and to form a pilot flame by burning air-fuel mixture (rich gas) of which the air-fuel ratio is higher than a theoretical air-fuel ratio of the gas at a rich-flame port disposed adjacent to each or one side of the lean-flame port. Among a variety of rich-lean burners of this type is one which includes a lean-gas inlet, a gas passage, a lean burner unit and a rich burner unit, as disclosed for example in Japanese Patent Application Laid-Open Publication No. 2001-182910. The lean burner unit includes a flame-port portion disposed at an upper side thereof. The flame-port portion accommodates flame port unit having lean-flame ports formed of slits. The rich burner unit is fixedly mounted on an upper portion of the lean burner unit from the right and left sides, and configured such that, once it is mounted, a pair of gas inlets and gas passages, as well as rich-flame ports disposed at the right and left sides of the lean-flame ports, are formed.

In the rich-lean burner as described above, however, each lean-flame port and the adjacent rich-flame ports are arranged with a gap of a predetermined distance left therebetween to form recirculation regions, in order to restrict interference between the main flames formed at the rich-flame ports and the basal portions of the pilot flames formed at the lean-flame ports thereby stabilizing the basal portions of the main flames. With this gap, the basal portions of the pilot flames at its lean-flame port side would likely become unstable, which resultantly causes the pilot flames to flutter, producing undesirable noises and vibrations as the case may be.

To stabilize combustion of the pilot flames at the rich-flame ports, Japanese Patent No. 4072088 describes an improved configuration in which the upstream ends of the outermost slits of the lean-flame ports are closed to thereby supply part of the lean gas into the gap through a communication hole formed in a partition plate defining an inner side of the outermost slit and through an aperture formed in a partition plate between the outermost slit and the gap.

The present invention is to provide a further improved rich-lean burner where no holes are used in a partition plate in which the partial supply of lean gas into the gap can be ensured without using holes.

SUMMARY OF THE INVENTION

A first aspect of the present invention is to provide a rich-lean burner which comprises a lean-flame port from which a lean gas that is a lean mixture of a gas and air is to be supplied for combustion and a rich-flame port from which a rich mixture of the gas and air is to be supplied for combustion. The rich-flame port is disposed adjacent to the lean-flame port with a gap having a predetermined distance being interposed between the lean-flame port and the rich-flame port. A first partition plate is disposed between the gap and the lean-flame port, and a second partition plate is disposed between the gap and the rich-flame port. One or more projections are provided on at least one of the first and second partition plates. Each of the projections protrudes from one of the first and second partition plates with a distal end thereof being in contact with the other of the first and second partition plates to keep the gap at the predetermined distance. The gap is in fluid communication with a supply passage through which the lean gas is to be supplied to the lean-flame port. A recessed portion is formed at an interface region between the distal end of at least one of the projections and the other of the first and second partition plates adjacent to the lean-flame port. The recessed portion is configured such that the distal end of the at least one of the projections is partially not in contact with the other of the first and second partition plates with a predetermined clearance left between the distal end of the at least one of the projections and the other of the first and second partition plates. The recessed portion allows the lean gas to be supplied through the clearance to the gap.

In a second aspect according to the first aspect, the recessed portion is formed at the distal end of the at least one of the projections.

In a third aspect according to the first aspect, the recessed portion is at an area of the other of the first and second partition plates corresponding to the interface region.

According to the configuration described above in the first aspect, the partial supply of lean gas into the gap can be ensured without using holes.

Further, according to the configuration with the additional feature described above in second or third aspect, the recessed portion can be formed at the same time as the at least one of the projections or the other of the first and second partition plates with which the projections are to be in contact are formed. Therefore, the recessed portion can be obtained easily.

BRIEF DESCRIPTION OF THE DRAWINGS

The above aspect, other advantages and further features of the present invention will become more apparent by describing in detail illustrative, non-limiting embodiments thereof with reference to the accompanying drawings.

DETAILED DESCRIPTION OF THE INVENTION

Exemplary embodiments of the present invention will be described hereinafter with reference to the accompanying drawings.

Figure 1:
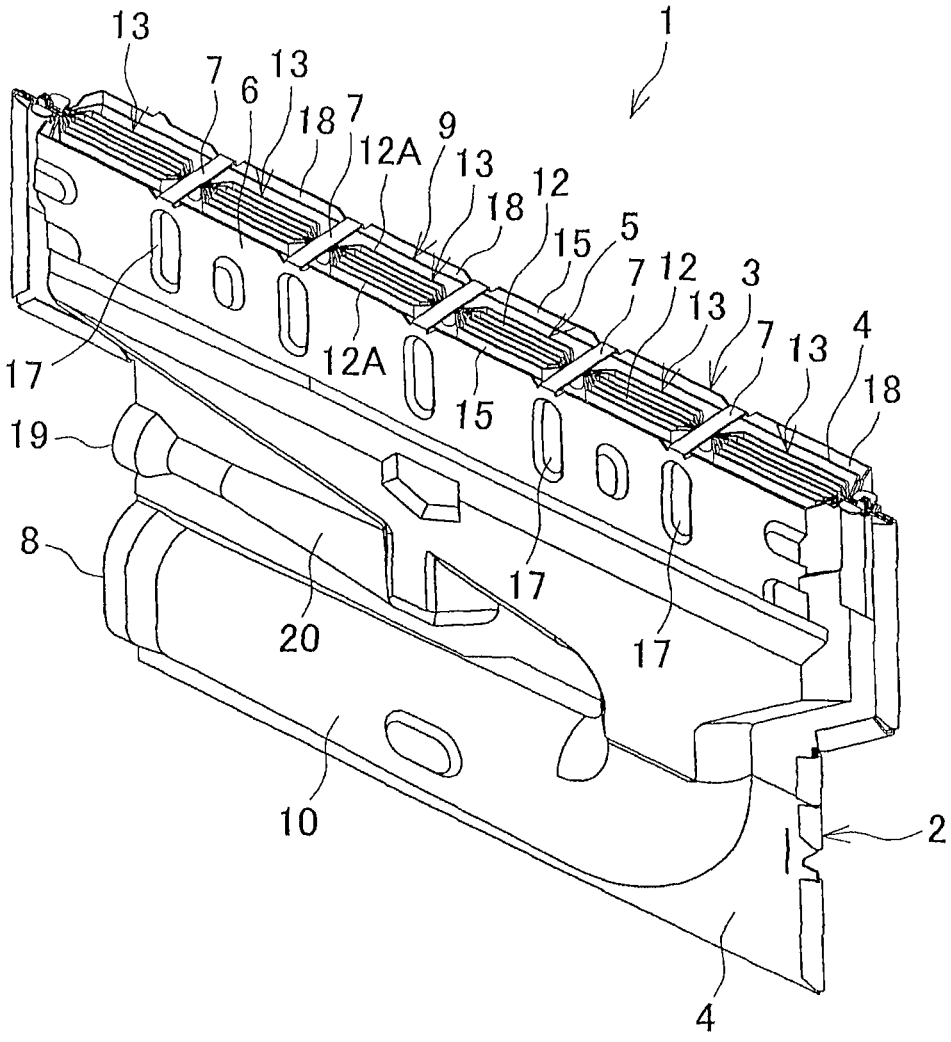
FIG. 1 is a perspective view of a rich-lean burner.
Figure 2:
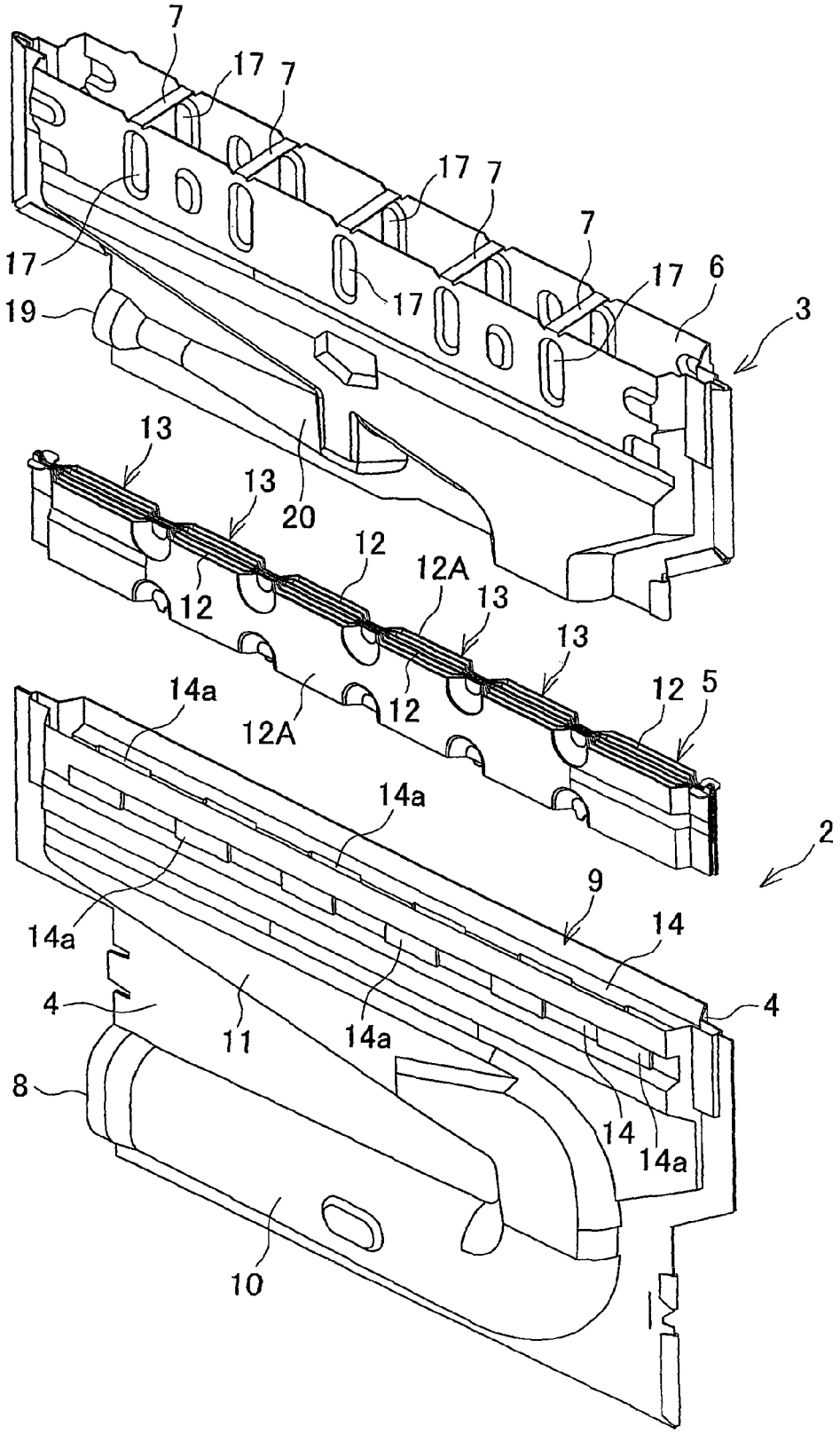
FIG. 2 is an exploded perspective view of the rich-lean burner.

Referring to FIGS. 1 and 2, a rich-lean burner 1 includes a lean burner unit 2 having lean-flame ports 13 configured to form main flames, and a rich burner unit 3 having rich-flame ports 18 configured to form pilot flames.

The lean burner unit 2 includes two stamped metal plates 4 which are spot-welded and swaged together to have a generally flat shape. A flame port unit 5 is held between upper portions of the two plates 4. The rich burner unit 3 includes a stamped metal plate 6 which is bent and folded to have a generally flat shape similar to the lean burner unit 2. An upper end of the rich burner unit 3, has openings with connecting pieces 7 left between the openings. The lean burner unit 2 is mounted with its upper portion sandwiched between opposed portions of the plate 6 from their thickness directions, and the rich burner unit 3 is spot-welded and swaged to be combined integrally with the lean burner unit 2.

The lean burner unit 2 includes an oval lean gas inlet 8 formed at one side edge of its lower portion and a lean gas outlet 9 formed at an upper end of its upper portion in which the flame port unit 5 is held by combining the two metal plates 4 together from the right and the left. The lean burner unit 2 further includes a U-shaped gas passage 10 disposed transversely between the lean gas inlet 8 and the lean gas outlet 9. A lower end of the gas passage 10 is connected to the lean gas inlet 8, and an upper end of the gas passage 10 is connected to the lean gas outlet 9. An upper portion of the gas passage 10 which is connected to the lean gas outlet 9 is shaped to form a pressure-equalizing chamber 11 tapered toward downward, namely the longitudinal dimension being longer toward upward. This configuration enables a distributed supply of gaseous mixture (lean gas) from the upper end portion of the gas passage 10 to the entire length of the lean gas outlet 9.

On the other hand, the flame port unit 5 is formed by stamping a single sheet of metal, cutting and separating the stamped sheet into six-fold separate belt-like partition plates 12 by trimming both edges (shorter sides facing in the longitudinal directions) thereof, which in turn are neatly stacked and folded at the both edges so that six lean-flame ports 13 each composed of five slits formed by the partition plates 12 disposed between adjacent slits are arranged longitudinally in a single row. The end portions (facing in the longitudinal directions with their edges trimmed away and folded down) of the flame port unit 5 are held by the metal plates 4 at the both ends of the lean gas outlet 9, so that the flame port unit 5 is held inside the lean gas outlet 9.

Figure 3:
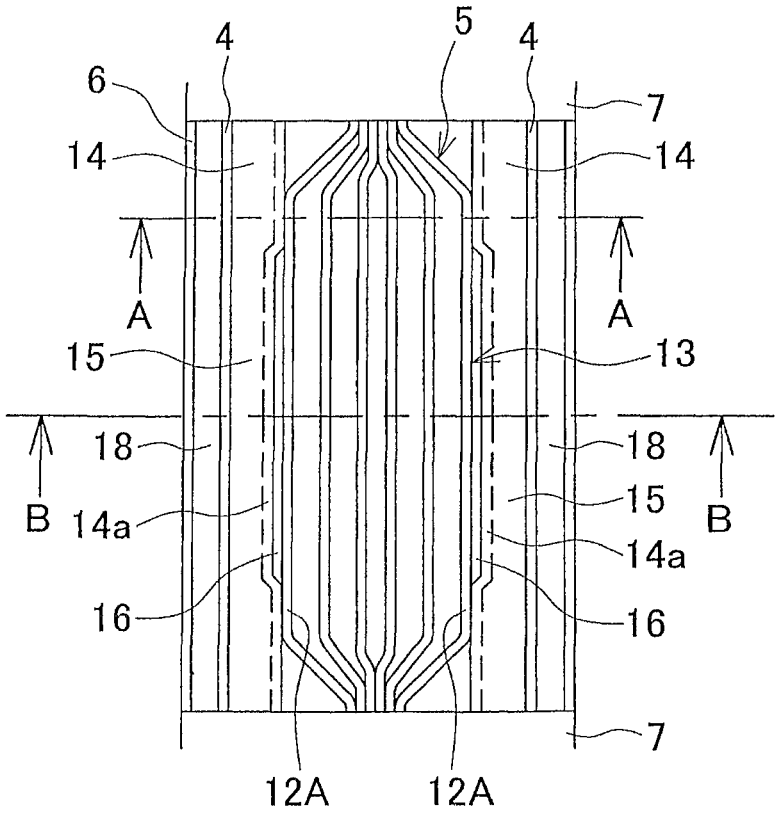
FIG. 3 is a plan view of a lean-flame port of the rich-lean burner.
Figure 4B:
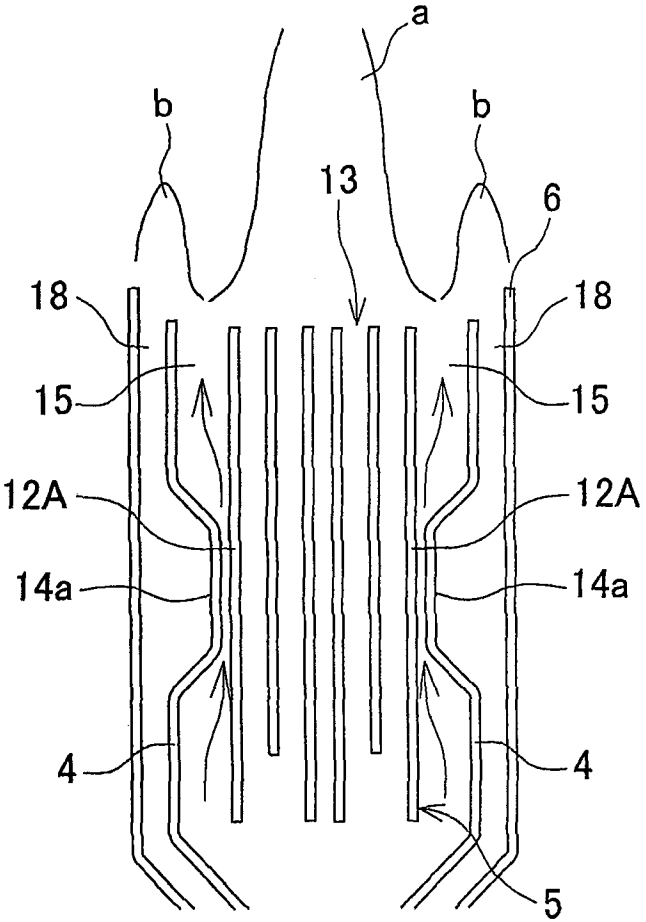
FIG. 4B is a sectional view taken along line B-B of FIG. 3.
Figure 4A:
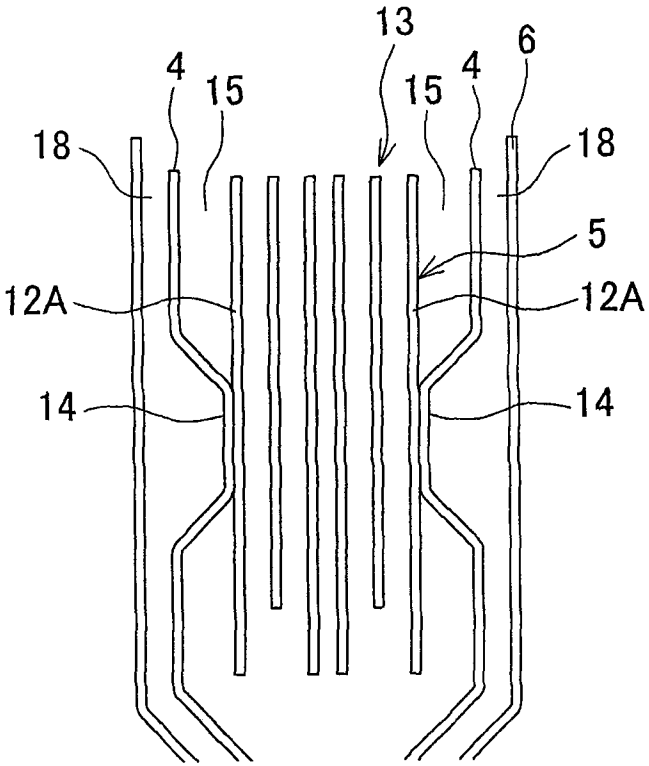
FIG. 4A is a sectional view taken along line A-A of FIG. 3.

In the lean burner unit 2, as shown in FIGS. 3 and 4A, the metal plates 4 located at the right and left sides of the flame port unit 5 have ridges 14 (projections) which protrude toward the flame port unit 5 and extend in the longitudinal direction. The ridges 14 are formed in a vertically middle position of the outermost partition plates 12A of the flame port unit 5 (note that the outermost partition plates are indicated by the numeral 12 with "A" appended as a suffix to make it distinguishable from the other partition plates). With these ridges 14, gaps 15 that are in communication with the pressure-equalizing chamber 11 at an upstream side of the flame port unit 5 are formed between each metal plate 4 and the corresponding partition plate 12A inside the lean gas outlet 9 which holds the flame port unit 5. In other words, the partition plates 12A and the metal plates 4 in this embodiment serve as the first partition plate and the second partition plate, respectively, as defined in the summary section of this description.

In addition, the ridges 14 have recessed portions 14*a* in regions adjacent to the lean-flame ports 13, arranged in a discrete manner, as shown in FIGS. 3 and 4B. The recessed portions 14*a* are configured to protrude less by a predetermined length than other portions of the ridges 14 so as not to be in contact with the partition plate 12A. With these recessed portions 14*a*, clearances 16 which establish communication between upper and lower spaces of the ridges 14 within the gaps 15 are formed between each lean-flame port 13 and the corresponding metal plate 4 which forms the ridge 14. As a result, small amount of lean gas can be supplied to the gaps 15 through the clearances 16. In this embodiment, the ratio of the amount of lean gas passing through the lean-flame ports 13 to the amount of lean gas flowing the right and left clearances 16 is adjusted to be 9:1, and thus one-tenth of the lean gas is supplied to the gaps 15.

On the other hand, the metal plate 6 of the rich burner unit 3 has inwardly protruding vertically elongated oval protrusions 17 formed in positions corresponding to the positions of the connecting pieces 7, so that when the rich burner unit 3 is mounted on the lean burner unit 2, the protrusions 17 (crests or distal ends thereof) are in contact with the metal plates 4. With this configuration, the rich-flame ports 18 disposed at the right and left sides of the lean-flame ports 13 with the gaps 15 interposed between each rich-flame port 18 and the lean-flame ports 13 are formed between the lean burner unit 2 and the rich burner unit 3. Each rich-flame port 18 is divided by the connecting pieces 7 into six regions located in positions corresponding to the positions of the lean-flame ports 13 arranged in the longitudinal direction. A rich gas inlet 19 is formed in the rich burner unit 3. The rich gas inlet 19 is disposed above the lean gas inlet 8 at the right and left sides of the lean burner unit 2. A gas passage 20 is provided to connect the right and left rich gas inlets 19 to the rich-flame ports 18.

In operation, the rich-lean burner 1 configured as described above is mounted to a mount frame (not shown), and gases are injected from a nozzle block fixed on the mount frame into the lean gas inlet 8 and the rich gas inlet 19. As a result, the lean gas which is mixed with air for combustion is supplied to the lean gas inlet 8 and passes through the gas passages 10. The rich gas which is mixed with air for combustion is supplied to inlet 19 and passes through the gas passages 20. Consequently, the lean gas and the rich gas are jetted out from the lean-flame ports 13 of the lean burner unit 2 and the rich-flame ports 18 of the rich burner unit 3, respectively. By starting the ignition device (not shown), such as discharge electrodes, to set fire to the gases being jetted out, combustion of the main flame a and the pilot flame b occurs at the lean-flame ports 13 and at the rich-flame ports 18, respectively, as shown in FIG. 4B.

During this combustion, most of the lean gas discharged through the lean gas outlet 9 passes through each lean-flame port 13 and is jetted out upwardly. However, part of the lean gas passes through the clearances 16 formed at the both sides of each lean-flame port 13 in the gaps 15 as shown by arrows in FIG. 4B and flows out upwardly from the gaps 15. Since the lean gas flowing through the gaps 15 burns upon contact with the basal end portions of the main flame a and the pilot flame b at their gap 15 sides, the basal ends of the main flame a and the pilot flame b are formed on and rises from the edges of the opening of the gaps 15. Accordingly, the combustion speed, particularly of the pilot flame b, at the gap 15 side is increased and the combustion is stabilized.

With the rich-lean burner 1 according to the present embodiment, the gaps 15 are configured to be in fluid communication with the gas passage 10 through which the lean gas is to be supplied to the lean-flame ports 13. Further, at the interface regions between the distal ends of the ridges 14 provided on the metal plates 4 of the lean burner unit 2 and the partition plates 12A, the recessed portions 14*a* are formed such that the distal ends of the ridges 14 are partially not in contact with the partition plates 12A with the predetermined clearances 16 left between the distal ends of the ridges 14 and the partition plates 12A. The lean gas is thereby allowed to be supplied through the clearances 16 to the gaps 15. As a result, the partial supply of lean gas into the gaps 15 can be ensured without using holes. Additionally, pilot flame combustion is stabilized by supply of a small amount of lean gas to the gaps 15 and associated reduction in noises and vibrations can be ensured.

Particularly, in this embodiment, the recessed portions 14*a* are formed at the crests of the ridges 14 (distal ends of the projections), so that the recessed portions 14*a* can be formed at the same time as the ridges 14 are formed. In other words, the recessed portions 14*a* can be obtained easily.

Figure 5:
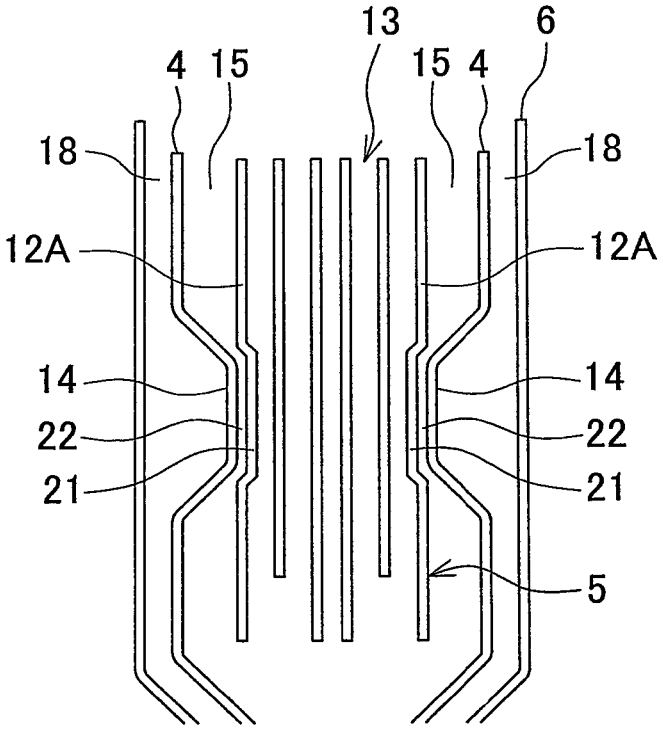
FIG. 5 is a sectional view of a lean-flame port as illustrated to represent a modified embodiment of the rich-lean burner shown in FIG. 1.

Although the recessed portions 14*a* which form the clearances 16, in the above-described embodiment, are provided at the ridges 14 in the metal plates 4 of the lean burner unit 2, particularly in the regions corresponding to the positions of the lean-flame ports 13, the recessed portions may be configured in a different manner. For example, as shown in FIG. 5, the ridges 14 provided in the metal plates 4 may be configured to protrude in the same amount of protrusion entirely along the length so as to be in contact with the partition plates 12A at the lean-flame ports 13 and recessed portions 21 are formed in the partition plates 12A. These recessed portions 21 are portions of the partition plates 12A partially recessed (protrudes inwardly toward the center of the lean-flame ports 13) in regions adjacent to the lean-flame ports 13, and configured such that the crests of the ridges 14 are partially not in contact therewith, to thereby make clearances 22 which provide fluid communication between the upper and lower portions of the ridges 14 within the gaps 15. In this alternative embodiment, as well, the similar advantageous effects as in the embodiment described above can be achieved. In this embodiment, the recessed portions 21 are formed in the partition plates 12A of the flame port unit 5, and can therefore be formed easily at the same time as the flame port unit 5 is formed.

In the above-described embodiments, the ridges protruding inwardly are formed in the metal plates as a second partition plate of the lean-burner unit. However, the ridges protruding outwardly may be formed instead in the outermost partition plate as a first partition plate of the flame port unit whereas recessed portions having a smaller amount of protrusion may be formed at the ridges partially in positions corresponding to the lean-flame ports, so that clearances can be formed between the ridges provided in the first partition plate and the second partition plate. Similarly, recessed portions may be formed at the second partition plate without varying the amount of protrusion of the ridges, and such recessed portions may be located in positions corresponding to the lean-flame ports and configured to partially protrude outwardly, to thereby form clearances. Furthermore, ridges may be formed at both of the first and second partition plates, and recessed portions may be formed at any one of the ridges; in this configuration, as well, clearances can be formed.

The present invention may not only be applied to such a rich-lean burner having rich-flame ports at both sides of the lean-flame ports as in the above-described embodiments, but also to another type of rich-lean burner in which a rich-flame port is formed at one side of the lean-flame port.

The configuration and arrangement of the flame port unit, the number of lean-flame ports and rich-flame ports, the configurations of the gas inlet and outlet and the gas passage may be modified where appropriate.

What is claimed is:

1. A rich-lean burner comprising:

a lean-flame port from which a lean gas that is a lean mixture of a gas and air is to be supplied for combustion;

a rich-flame port from which a rich mixture of the gas and air is to be supplied for combustion, and which is disposed outwardly adjacent to the lean-flame port with a gap that vertically extends from a lower portion to an upper portion of the burner and having an opening of the gap being interposed between the lean-flame port and the rich-flame port;

a first partition plate disposed between the gap and the lean-flame port;

a second partition plate disposed between the gap and the rich-flame port; and a plurality of projections provided on at least one of the first and second partition plates, each of the projections protruding from one of the first and second partition plates with a distal end thereof being in contact with the other of the first and second partition plates to form the opening of the gap having a predetermined size therebetween, wherein the gap is in fluid communication with a gas supply passage at the lower portion of the burner through which the lean gas is to be supplied to the lean-flame port, and wherein a recessed portion is formed at an interface region between the distal ends of the plurality of projections and the other of the first and second partition plates adjacent to the lean-flame port, the recessed portion being configured such that in the interface region the plurality of projections are partially not in contact with the other of the first and second partition plates to form a reduced and predetermined clearance between the distal ends of the plurality of projections and the other of the first and second partition plates in the gap that vertically extends from the gas supply passage at the lower portion of the burner to the upper portion of the burner, such that the entire reduced amount of the lean gas is supplied through the predetermined clearance to the opening of the gap.

2. The rich-lean burner according to claim 1, wherein the recessed portion is formed at the distal end of the plurality of projections.

3. The rich-lean burner according to claim 1, wherein the recessed portion is formed at an area of the other of the first and second partition plates corresponding to the interface region.

* * * * *